United States Patent [19]

Goto et al.

[11] Patent Number: 4,711,433

[45] Date of Patent: Dec. 8, 1987

[54] COPPER CONVERTER

[75] Inventors: Motoo Goto, Nagareyama; Hiroshi Kono, Iwaki; Haruhiko Asao, Iwaki; Yukio Miyamoto, Iwaki; Toshihiko Igarashi, Iwaki, all of Japan

[73] Assignee: Mitsubishi Kinzoku Kabushiki Kaisha, Tokyo, Japan

[21] Appl. No.: 873,784

[22] Filed: Jun. 12, 1986

[30] Foreign Application Priority Data

Jun. 13, 1985 [JP] Japan ..... 60-128970
Jun. 13, 1985 [JP] Japan ..... 60-128971
Jun. 13, 1985 [JP] Japan ..... 60-128972

[51] Int. Cl.[4] ..... C21C 5/48

[52] U.S. Cl. ..... 266/222; 266/87; 266/267

[58] Field of Search ..... 266/87, 222, 267; 75/75, 76

[56] References Cited

U.S. PATENT DOCUMENTS 2,448,199 8/1948 Vollrath ..... 266/87
3,608,881 9/1971 Yordanov et al. ..... 266/267
3,897,048 7/1975 Pearce et al. ..... 266/222
4,040,612 8/1977 Leroy et al. ..... 266/222

FOREIGN PATENT DOCUMENTS 119959 5/1976 Fed. Rep. of Germany .

*Primary Examiner*—L. Dewayne Rutledge
*Assistant Examiner*—Robert L. McDowell
*Attorney, Agent, or Firm*—Cushman, Darby & Cushman

[57] ABSTRACT

A copper converter which includes: a converter body; a plurality of tuyeres disposed to the converter body, each tuyere having an outer end portion; a first concentrate blowing pipe assembly disposed at least one of said tuyeres, the concentrate blowing pipe assembly including an introducing pipe inserted into the at least one tuyere; a blowing unit, connected to the concentrate blowing pipe assembly, for blowing a material including a concentrate through the introducing pipe into the converter; an air supplying unit, disposed to the tuyeres, for supplying pressurized air to the tuyeres; and formations, disposed to said outer end of each tuyere and said concentrate blowing pipe assembly, for detachably interlocking the introducing pipe with the at least one tuyere.

8 Claims, 5 Drawing Figures

COPPER CONVERTER

BACKGROUND OF THE INVENTION

The present invention relates to a copper converter in which melting of a concentrate is carried out simultaneously with the oxidation of a matte which has been produced in a smelting furnace.

Japanese Patent (18-month) Publication No. 57-192233 discloses such a kind of a copper converter, in which concentrate blowing pipes are inserted into corresponding tuyeres of the converter, the tuyeres being each communicated to a blast pipe. In this prior art converter, a concentrate is supplied to a tank, from which it is blown with pressurized air through the blowing pipes into the converter while pressurized air is supplied from the blast pipe into the tuyeres so as to surround the blowing pipes and into the converter. Although this converter is advantageous in that it reduces fuel consumption and hence an amount of resultant fuel combustion gases, it has a drawback in that it is rather laborious to insert the concentrate blowing pipes into and remove them from the tuyeres in connection with the turning of the converter for charging a matte produced in a reverberatory furnace into the converter and for discharging a blister copper produced in it. This deteriorates the productivity of the converter.

SUMMARY OF THE INVENTION

Accordingly, it is an object of the present invention to provide a copper converter in which the attaching and detaching of concentrate blowing pipes are easily carried out, so that the productivity of the converter is enhanced.

In view of this and other objects, the present invention provides a copper converter which includes: a converter body; a plurality of tuyeres disposed to the converter body, each tuyere having an outer end portion; a first concentrate blowing pipe assembly disposed at least one of said tuyeres, the concentrate blowing pipe assembly including an introducing pipe inserted into the at least one tuyere; a blowing unit, connected to the concentrate blowing pipe assembly, for blowing a material including a concentrate through the introducing pipe into the converter; an air supplying unit, disposed to the tuyeres, for supplying pressurized air to the tuyeres; and an interlocking mechanism, disposed to said outer end of each tuyere and said concentrate blowing pipe assembly, for detachably interlocking the introducing pipe with the at least one tuyere.

The concentrate blowing pipe assembly may include a radially outwardly projecting attachment member rigidly mounted around a one end portion of the introducing pipe, and the interengaging formation of the concentrate blowing assembly may be formed at the attachment member.

In a preferred form of the present invention, the interengaging formation of the outer end of the tuyere includes a plurality of locking pins projecting radially outwards from the outer end of the tuyere, wherein said attachment member of the concentrate blowing pipe assembly comprises a sleeve portion, rigidly mounted around the introducing pipe, and a hollow cylindrical portion, having an inner diameter larger than the sleeve portion and formed substantially concentrically and integrally with the sleeve portion, and wherein the interengaging formation of said attachment member has a plurality of slots formed in the hollow cylindrical portion of the attachment member, each slot being adapted to detachably engage with corresponding one of said locking pins. With such a construction, the attaching and detaching of the concentrate blowing pipe assembly is easily carried out.

Preferably, the concentrate blowing pipe assembly may include: sealing means, fitted into the hollow cylindrical portion of the attachment member, for sealing the outer end of said one tuyere; and resilient means, placed within the attachment member, for resiliently urging the sealing means against the outer end of the one tuyere for sealing the outer end when the locking pins of the one tuyere engage with the slots of the attachment member to releasably lock the concentrate blowing pipe assembly to the tuyere. With the sealing means and the resilient means, sealing of the tuyere is automatically carried out when the locking pins engage with corresponding slots.

In another modified form of the present invention, the copper converter includes a second concentrate blowing pipe assembly having the same structure as the first concentrate blowing pipe assembly, said second concentrate blowing pipe assembly disposed so as to insert an introducing pipe thereof into another tuyere; and temperature detecting means, mounted on the sleeve portion of said attachment member, for detecting temperature of a molten material within the converter body through the sleeve portion and the introducing pipe, said second temperature detecting means including a radiation pyrometer. With this construction, the first and the second concentrate blowing pipe assemblies may be easily interchanged since they have the same attaching and detaching mechanism. Thus, the concentrate and a solid fuel may be blown through desired tuyeres into the converter, so that an accurate temperature distribution of the molten material may be achieved.

The introducing pipe of the first concentrate blowing assembly may be cut at the other end thereof slantingly to the axis thereof so that the slantingly cut end faces downwards when the locking pins are brought into engagement with the slots. With this beveled end of the introducing pipe, a concentrate which is blown into a molten matte within the converter through the introducing pipe is prevented from going upwards, so that the melting of the concentrate is carried out relatively smoothly.

DETAILED DESCRIPTION OF THE INVENTION

Figure 1:
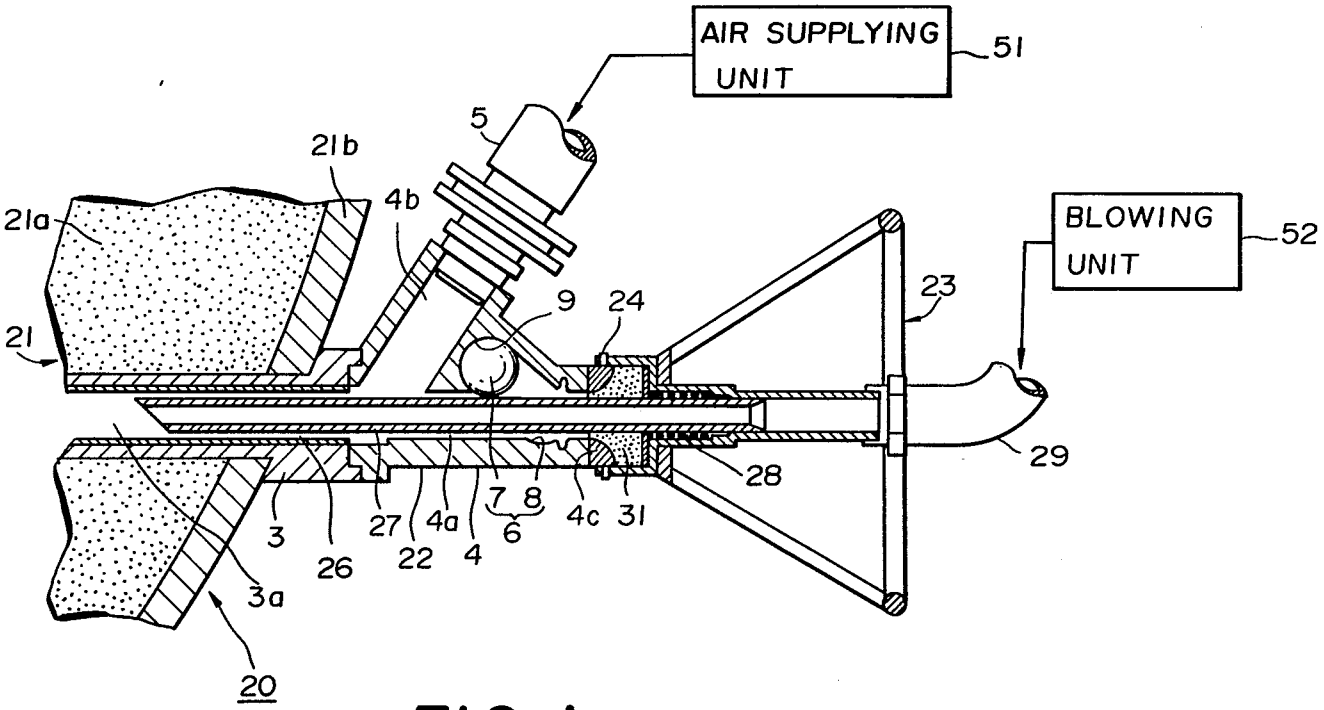
FIG. 1 is a vertical section of an essential portion of a copper converter constructed according to the present invention.
Figure 2:
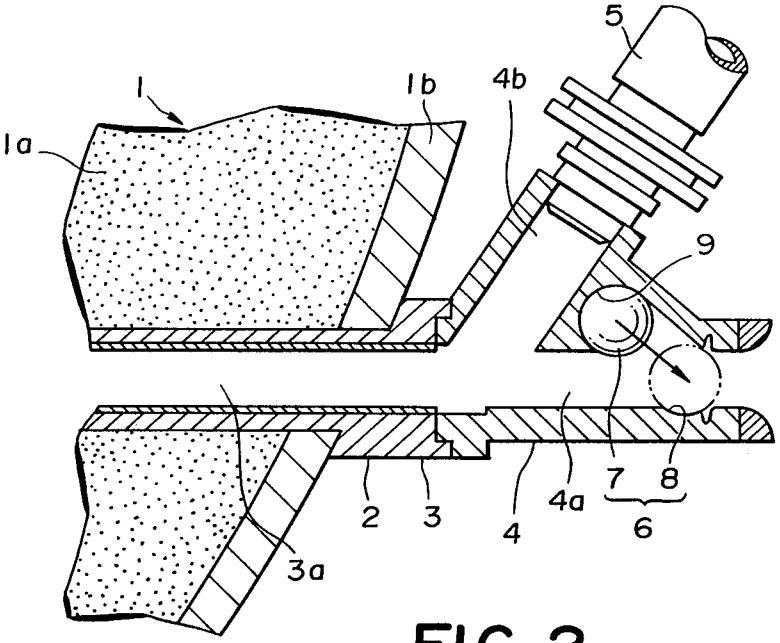
FIG. 2 is an enlarged vertical section of the tuyere in FIG. 1, in which the concentrate blowing pipe assembly is withdrawn.

Referring to FIGS. 1–4, there is illustrated a concentrate blowing pipe assembly 23 constructed according to the present invention. A plurality of concentrate blowing pipe assemblies 23 are provided to a copper converter 20, of which converter body 21 includes a brick lining 21*a* and an steel plate wall 21*b* surrounding the brick lining 21*a*. A large number of tuyeres 22 are disposed to one side of the converter body 21. Each tuyere 22 has a straight pipe 3, which passes through both the brick lining 21*a* and the steel plate wall 21*b*, and a joint pipe 4 connected to an outer end of the straight pipe 3. The joint pipe 4 has a straight passage 4*a* formed through it so as to concentrically communicate to a passage 3*a* defined by the straight pipe 3. The joint pipe 4 further has a branch passage 4*b* branched from the straight passage 4*a*. The branch passage 4*b* is connected to a blast pipe 5 which is in turn connected to an air supplying unit 51 including a compressor not shown. The wall of the straight passage 4*a* is provided with a valve mechanism which includes a ball 7 having a larger diameter than the straight passage 4*a*, a valve sheet 8 and a ball receiving portion 9. When a punching rod (not shown) or concentrate blowing pipe assembly 23 is removed from the tuyere 22, the ball 7 drops from the ball receiving portion 9 in the valve sheet 8 as shown by the phantom line in FIG. 2, thus sealing the passage 4*a*. The rear end wall of the straight passage 4*a* of each joint pipe 4 has a ring-shaped member 4*c* welded to it. The ring-shaped member 3*a* has a funnel-shaped inner face and is provided to its outer face with a pair of radially outwardly extending locking pins 24 and 24 so that they are disposed symmetrically with respect to the axis of the ring-shaped member.

Figure 5:
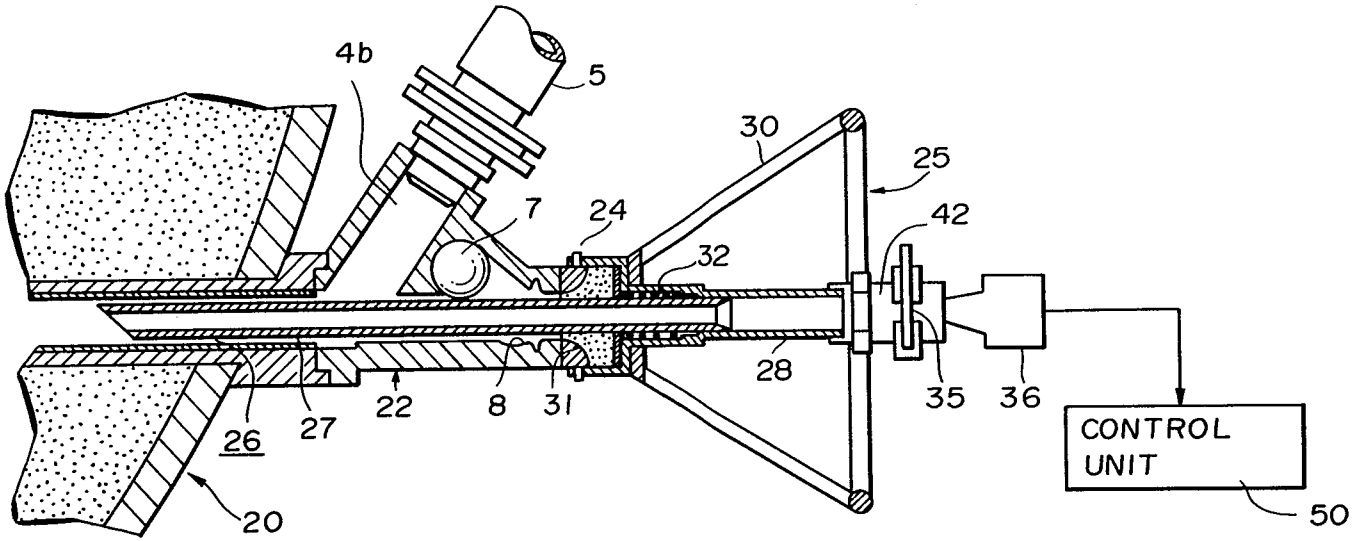
FIG. 5 is a vertical section of a tuyere of the converter in FIG. 1, the tuyere being provided with a temperature detecting unit.

In this embodiment, about fifty tuyeres 22, each having the locking pins 24 thus projected, are disposed on one side of the converter body 21 at a predetermined pitch. Concentrate blowing pipe assemblies 23 are, as shown in FIG. 1, provided to some of the tuyeres 22 and detecting units 25 are, as shown in FIG. 5, provided to the rest of the tuyeres 22 for detecting the temperature of a molten material within the converter body 21.

Figure 3:
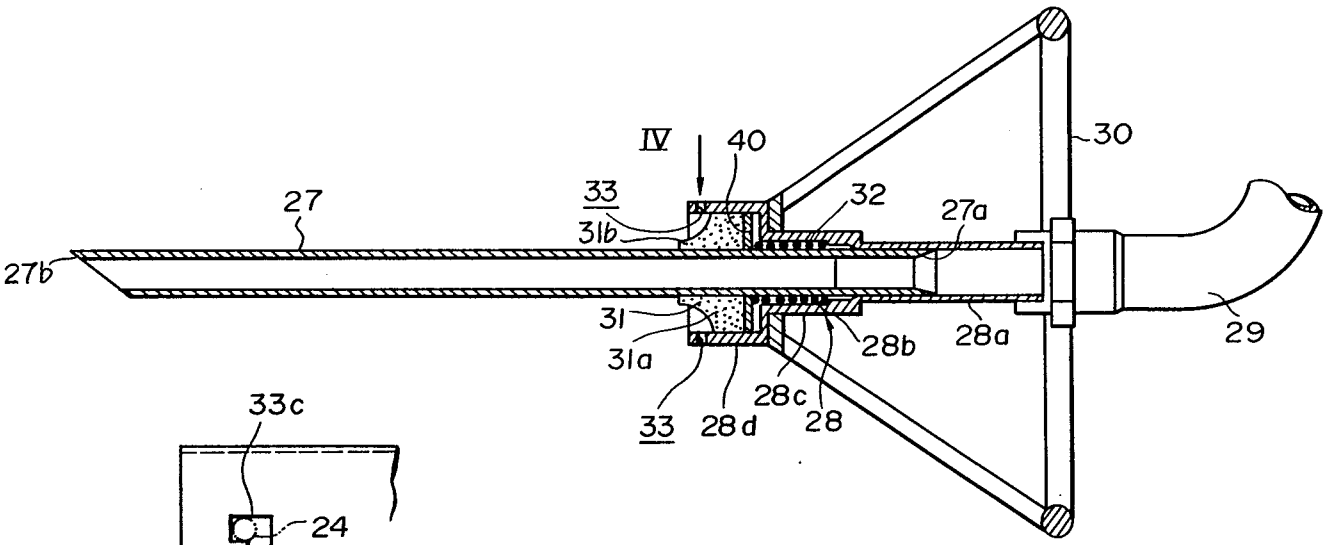
FIG. 3 is an enlarged axial cross section of the concentrate blowing pipe assembly in FIG. 1.

Each concentrate blowing pipe assembly 23, as shown in FIG. 3, includes an introducing pipe 27, an attachment pipe 28, and a handle 30 mounted on a front end portion of the attachment pipe 28. The introducing pipe 27 is fitted at its rear end into the attachment pipe 28 and is attached there. The concentrate blowing pipe assembly 23 is communicated through a supply hose 29, which is connected to the rear end of the attachment pipe 28, to a conventional blowing unit 52 for blowing a concentrate, a solid fuel, such as pulverized coal, etc to the introducing pipe 27 with pressurized air. The introducing pipe 27 is designed to have an outer diameter smaller than the diameter of the passage 3*a* of the tuyere body 3 and is inserted through the straight passage 4*a* into the passage 3*a*, so that an tubular air passage 26 is, as illustrated in FIG. 1 defined between the inner wall of the tuyere body 3 and the outer face of a tip portion of the introducing pipe 27.

Figure 4:
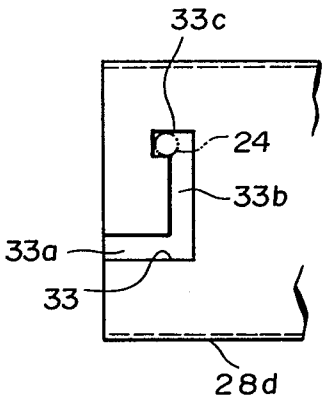
FIG. 4 is an enlarged view in the direction of the arrow IV in FIG. 3.

As illustrated in FIG. 3, each attachment pipe 28 includes a communicating pipe portion 28*a* for communicating the hose 29 to the introducing pipe 27, an intermediate diameter portion 28*c* which is integrally formed with the front end of the communicating pipe portion 28*a* and has a diameter larger than the the communicating pipe portion 28*a*, and an attachment portion 28*d* which is integrally formed with the front end of the intermediate portion 28*c* and has a larger diameter than the intermediate portion. The intermediate portion 28*c* defines a tubular resilient member receiving recess 28*b* around the introducing pipe 27. A coil spring 32 is received in the resilient member receiving recess 28*b* so as to fit around the introducing pipe 27. The attachment portion 28*d* has a hollow cylindrical shape and has a heat resistant rubber packing 31 fitted into it. The packing 31 is slidably mounted around the introducing pipe 27 and is spring biased by the coil spring 32 toward the tip of the introducing pipe 27 through a ring 40 slidably fitted around the introducing pipe 27. The attachment portion 28*d* has a pair of substantially hook-shaped locking through slots 33 and 33 formed symmetrically about its axis through its front end portion although only one locking slot 33 is illustrated in FIG. 4. Each locking slot 33 consists of a pin introducing portion 33*a* which axially extends to open at the front edge of the attachment portion 28*d*. From the rear end of the pin introducing portion 33*a*, there circumferentially extends an intermediate portion 33*b*, which terminates in a locking portion 33*c* extending axially toward the front edge of the attachment portion 28*d*.

The front end 27*b* of the introducing pipe 27 is cut slantingly to the axis thereof so that the front end 27*b* faces downwards when each of the concentrate blowing pipe assembly 23 is set to a corresponding tuyeres 22 as shown in FIG. 1. With this beveled end 27*b*, a concentrate which is blown into a molten matte within the converter 20 through the introducing pipe 27 is prevented from going upwards, so that the melting of the concentrate is carried out relatively smoothly. When the front end 27*b* is set to face upwards, the concentrate goes upwards and then floats on the molten metal level, so that it is hard to melt the concentrate efficiently. The rear end of the introducing pipe 27 is chamfered at its inner face, thus forming a tapered portion 27*a*. The tapered portion 27*a* serves to smoothly introduce a fuel, such as a pulverized coal, and a concentrate from the concentrate supply hose 29 into the introducing pipe 27 so that they are prevented from impinging upon the rear end of the introducing pipe 27.

The packing 31 has a cylindrical base portion 31*a* and a substantially frustoconical front portion 31*b* integrally formed with the base portion 31*a*. The front portion 31*b* has a curved face designed to be complementary with the funnel-shaped inner face of the ring-shaped member 4*c* of each tuyere 22. Thus, each concentrate blowing pipe assembly 23 are sealingly connected to corresponding tuyeres 22 by fitting the front portion 31*b* of the packing 31 into the ring-shaped member 4*c*.

The attaching and detaching of each concentrate blowing pipe assembly 23 with respect to corresponding tuyeres 22 are relatively easily carried out. That is, in attaching each assembly 23, the introducing pipe 27 is inserted into the passage 3*a* of a corresponding tuyere 22 through the straight passage 4*a* of the joint pipe 4 and then the attachment portion 28*d* is turned about its axis by turning the handle 30 so that locking pins 24 are placed in front of pin introducing portions 33*a* of respective locking slots 33. Thereafter, the pins 24 and 24 are caused to enter into introducing portions 33*a* of respective locking slots 33 and 33 by pushing the handle 30 forwards against the resilient force of the coil spring 32. When the pins 24 reach to the inner most portions of the introducing portions 33*a* of the locking slot 33, the handle 30 is turned so that pins 24 enter into intermediate portions 33*b* of respective locking slots 33 until they reach the terminal portions of the intermediate portions, where each pin 24 is automatically brought by resilient force of the coil spring 32 into engagement with the locking portion 33*c* of the corresponding locking slot 33. Thus, each concentrate blowing pipe assembly 23 is locked to the corresponding tuyere 22 as shown in FIG. 1. In detaching the blowing pipe assembly 23 from the corresponding tuyere 22, the handle 30 is pushed forward to disengage the pins 24 from the locking portions 33*c* of corresponding locking slots 33 and then operation reverse to the blowing pipe assembly attaching operations above stated is made.

As illustrated in FIG. 5, each of the temperature detecting units 25 also has the introducing pipe 27, attachment pipe 28, handle 30, packing 31 and coil spring 32 and is detachably attached to the corresponding tuyere 22 in the same manner as the blowing pipe assemblies 23. The detecting unit 25 has an adaptor 42 connected to the rear end of the attachment pipe 28. Although not shown in FIG. 3, an adaptor similar to this adaptor 42 is attached to the attachment pipe 28 in the same manner and the supply hose 29 is fitted around on it. A transparent partition plate 35 made of a heat resistant glass is mounted to the adaptor 42 and a radiation pyrometer 36 is attached to the rear end of the adaptor 42 so that the temperature of the molten material within the converter 20 may be detected through the partition plate 35. The detected temperature of the molten material is transmitted in electric signals to conventional electronic control unit 50 for controlling the converter 20 through the air supplying unit 51 and the blowing unit 52. A desired number of detecting units 25 are provided in a predetermined distribution to tuyeres 22 so that a desired temperature distribution of the molten material within the converter 21 is determined by temperatures detected by the detecting units 25.

The number of concentrate blowing pipe assemblies 23 depends on a supply of the concentrate, and the mounting positions thereof to the converter are determined according to a temperature distribution detected by the detecting units 25 so that the material may be smoothly molten in predetermined conditions.

The operations of the converter 20 will be described. When the converter body 21 is turned a predetermined angle for charging a matte produced in the previous melting step or for discharging a blister copper to a refining furnace of the subsequent refining step, the concentrate blowing pipe assemblies 23 are detached from the tuyeres 22. The removal of the concentrate blowing pipe assemblies 23 facilitates rotation operation of the converter body 21 and minimizes the space which should be reserved around the converter 20 for preventing tuyere components from impinging upon surrounding provisions in rotation of the converter 20.

Then, a matte which has been produced in the previous step is charged into the converter body 21. In carrying out the melting of the concentrate simultaneously with the oxidation treatment of matte, a predetermined number of concentrate blowing pipe assemblies 23 are subsequently fitted in a desired distribution into corresponding tuyeres 22 while detecting units 25 are disposed in some of the remaining tuyeres 22. Thereafter, a concentrate or a mixture of the concentrate with a solid fuel, such as a pulverized coal, is blown under pressure into the converter 20 through the attachment pipe 23 and the introducing pipe 27 of each blowing pipe assembly 23 while air is pumped through the blaster pipe 5. The flow rate of the pressurized air and the supply of each of the solid fuel and the concentrate are appropriately adjusted by the control unit 50 according to the temperature distribution detected by the detecting unit 25.

When the temperature distribution is not sufficiently uniform, adjustment is made by changing the mounting positions of the concentrate blowing unit assemblies 23. In this event, the concentrate blowing unit assemblies 23 and the temperature detecting units 25 mounted to tuyeres 20 may be easily interchanged since they have the same attaching and detaching mechanism as described. Thus, the mounting positions of the concentrate blowing assemblies 23 are not restricted by the presence of the temperature detecting units 25 and hence a concentrate and a solid fuel may be blown through desired tuyeres 22 into the converter 20 together with air, so that an accurate temperature distribution of the molten material may be achieved.

In each temperature detecting unit 25, the air passage 26, which is defined between the outer face of the introducing pipe 27 and the inner wall of the tuyere body 3, forms a substantially uniform air flow layer or air curtain in contact with the inner wall of the tuyere body 3. The air flow comes into contact with the inner wall of the inner end of the tuyere body 3, thus effectively preventing the molten matte from adhering to and being solidified at the inner end. Hence, plugging of the tuyeres is effectively prevented and accurate temperature detection is continuously carried out for a long period of time. The diverging of the concentrate which is being blown into the converter 20 is prevented by means of the introducing pipe 27 of the blowing unit 23 and it is hence forced to pass through an axial portion of the passage 3*a* into the converter body 21. Around the flow of the concentrate there is formed the annular air flow or air curtain above described. In the presence of the air flow, the blown concentrate is prevented from impinging upon the inner face of the straight pipe 3, so that damage to the tuyere 22 due to the impinging of the concentrate is effectively prevented, thus resulting in prolongation of the lives of tuyeres 22.

The concentrate thus blown into the converter 20 becomes molten by the heat of the molten material within the converter body and by the combustion heat of the solid fuel blown together without necessity of heating by burners or like heating means. The melting of the concentrate is not achieved at once but is gradually made by the agitation of the molten material due to air streams within the converter body 21. A sufficient amount of air for completely burning the solid fuel is not supplied within the converter 20 near tuyeres 22 which are blowing the concentrate and the solid fuel into it, so that the fuel is incompletely burned with a small rise in temperature, with the result that there is not a large difference in temperature between portions within the converter near the tuyeres 22 having the concentrate blowing assemblies 23 and portions near other tuyeres 22 having no blowing assembly 23. The fuel incompletely burnt is gradually burnt due to contact with magnetite ($Fe_3O_4$) which is produced by agitation of the molten material near tuyeres 22 which blow only air, so that the temperature distribution of the molten material within the converter 20 is kept substantially uniform.

A large amount of FeS remains without being oxidized as well as $Cu_2S$ since the concentrate is not supplied with a sufficient amount of air near tuyere 22 which blow it into the converter 20. On the other hand, oxidation of the FeS excessively proceeds and with respect to part of FeS, oxidation proceeds until it becomes $Fe_3O_4$. Then, FeS and $Fe_3O_4$ make contacts with each other by the agitation of the molten material due to the air streams and thus make a reduction reaction represented by the following formula:

$$FeS + 3\ Fe_3O_4 \rightarrow 10\ FeO + SO_2$$

Thus, oxidation, which is an exothermic reaction, and reduction, which is an endothermic reaction, occur in the same converter, and hence the temperature distribution of the molten material is kept fairly uniform. This enables both the oxidation treatment of the matte and the melting of the concentrate to be carried out in predetermined conditions and hence blister copper of a high grade may be produced.

What is claimed is:

1. A copper converter comprising:

(a) a converter body;

(b) a plurality of tuyeres provided on the converter body, each tuyere having an outer end portion;

(c) a first concentrate blowing pipe assembly provided on at least one of said tuyeres, each said first concentrate blowing pipe assembly including an introducing pipe inserted into a respective one of said tuyeres;

(d) a blowing means, connected to each said first concentrate blowing pipe assembly, for blowing a material including a concentrate through a respective said introducing pipe into the converter;

(e) air supplying means, provided on said tuyeres, for supplying pressurized air to said tuyeres; and (f) formations provided both on said outer end of each tuyere and on each said first concentrate blowing pipe assembly and adapted to detachably interengage;

each said first concentrate blowing pipe assembly comprising a radially outwardly projecting attachment member rigidly mounted around a one end portion of the respective said introducing pipe;

each said interengaging formation of each said first concentrate blowing pipe assembly being formed on the respective said attachment member;

each said interengaging formation provided on the outer end of each tuyere comprising a plurality of locking pins projecting radially outwards from the outer end of the respective said tuyere, said attachment member of each first concentrate blowing pipe assembly comprising a sleeve portion, rigidly mounted around the respective said introducing pipe, and a hollow cylindrical portion, having an inner diameter larger than the respective said sleeve portion and formed substantially concentrically and integrally with the respective said sleeve portion, and wherein said interengaging formation of each said attachment member comprises a plurality of slots formed in the respective said hollow cylindrical portion of the respective said attachment member, each said slot being adapted to detachably engage with a corresponding one of said locking pins.

2. A copper converter as recited in claim 1, wherein:

each said first concentrate blowing pipe assembly comprises: a sealing means fitted into said hollow cylindrical portion of the respective attachment member for sealing the outer end of a respective said tuyere; and resilient means, placed within the respective attachment member, for resiliently urging the sealing means against the outer end of the respective tuyere for sealing the outer end when said locking pins of the respective tuyere engage with said slots of the respective attachment member to releasably lock the respective said first concentrate blowing pipe assembly to the respective tuyere.

3. A copper converter as recited in claim 2, wherein:

each said sealing means comprises an annular packing member, fitted around the respective said introducing pipe, and an annular plate fitted around the respective said introducing pipe in contact with the respective said packing member and between the respective said packing member and the respective said resilient means, and wherein said resilient means comprises a coil spring placed around the respective said introducing pipe in contact with said annular plate for transmitting a resilient force therefrom to the respective said packing member through said annular plate.

4. A copper converter as recited in claim 3, further comprising:

a second concentrate blowing pipe assembly which is substantially similar in structure to each said first concentrate blowing pipe assembly, said second concentrate blowing pipe assembly being disposed so as to insert a said introducing pipe thereof into another said tuyere; and temperature detecting means mounted on a said sleeve portion of a said attachment member of said second concentrate blowing pipe assembly for detecting temperature of a molten material within said converter body through said sleeve portion and said introducing pipe, said temperature detecting means including a radiation pyrometer.

5. A copper converter as recited in claim 4, wherein:

said temperature detecting means comprises a transparent, heat-resistant glass partition mounted on a rear end portion of said sleeve portion of said attachment member of said second concentrate blowing pipe assembly, and said heat-resistant glass parition sealing the inside of said introducing pipe of said second concentrate blowing pipe assembly from the outside.

6. A copper converter as recited in claim 5, wherein:

said introducing pipe of each said first concentrate blowing pipe assembly is cut at an inner end thereof slantingly to the longitudinal axis thereof so that a slantingly cut end thereof faces downwards when the respective said locking pins are brought into engagement with the respective said slots.

7. A copper converter comprising:

(a) a converter body;

(b) a plurality of tuyeres provided on the converter body, each tuyere having an outer end portion;

(c) a concentrate blowing pipe assembly including an introducing pipe adapted to be inserted into at least one of said tuyeres, said introducing pipe having a radially outwardly projecting attachment member mounted around one end portion thereof;

(d) blowing means, connected to said first concentrate blowing pipe assembly, for blowing a material including a concentrate through the introducing pipe into the converter;

(e) air supplying means, provided on said tuyeres, for supplying pressurized air to the tuyeres; and (f) formations provided on both the outer end of each tuyere and on said attachment member of said first concentrate blowing pipe assembly, said formations including slots and locking pins releasably engaging said slots for releasable interengagement between said attachment member and the outer end of a selected said tuyere.

8. A copper converter as recited in claim 7, wherein: when said introducing pipe of said first concentrate blowing pipe assembly is disposed in a selected said tuyere, said locking pins project radially outwards from the outer end of said selected tuyere, said attachment member of said concentrate blowing pipe assembly comprises a sleeve portion rigidly mounted around said introducing pipe, and a hollow cylindrical portion having an inner diameter which is larger than said sleeve portion and which is formed substantially concentrically and integrally with said sleeve portion, and wherein said slots are formed in said hollow cylindrical portion of said attachment member.

* * * * *